US007988608B2

(12) United States Patent
Schnell et al.

(10) Patent No.: US 7,988,608 B2
(45) Date of Patent: Aug. 2, 2011

(54) APPARATUS FOR PRODUCING LONGITUDINALLY FOLDED PRODUCTS

(75) Inventors: Helmut Schnell, Augsburg (DE); Urban Spatz, Neusaess (DE)

(73) Assignee: manroland AG, Offenbach am Main (DE)

( * ) Notice: Subject to any disclaimer, the term of this patent is extended or adjusted under 35 U.S.C. 154(b) by 238 days.

(21) Appl. No.: 12/470,189

(22) Filed: May 21, 2009

(65) Prior Publication Data

US 2009/0305860 A1 Dec. 10, 2009

(30) Foreign Application Priority Data

May 27, 2008 (DE) ..... 10 2008 025 416
Jul. 11, 2008 (DE) ..... 10 2008 032 621

(51) Int. Cl.
*B31B 1/26* (2006.01)

(52) U.S. Cl. ..... 493/416; 493/358; 493/475; 493/477; 270/5.01; 270/40; 270/41

(58) Field of Classification Search ..... 493/356–359, 493/365, 416, 440, 475–479; 270/5.01, 5.02, 270/21.1, 32, 40, 41; 101/225–228
See application file for complete search history.

(56) References Cited

U.S. PATENT DOCUMENTS

| | | | | |
|---|---|---|---|---|
| 4,279,410 | A * | 7/1981 | Bolza-Schunemann | 270/6 |
| 4,373,713 | A | 2/1983 | Loebach | |
| 4,545,782 | A * | 10/1985 | Niemiro et al. | 493/425 |
| 4,811,641 | A * | 3/1989 | Muller | 83/105 |
| 5,029,842 | A * | 7/1991 | Belanger et al. | 271/188 |
| 5,303,909 | A * | 4/1994 | Maylaender | 270/5.01 |
| 5,503,379 | A * | 4/1996 | Michalik et al. | 270/5.01 |
| 6,010,122 | A * | 1/2000 | Weber | 270/41 |
| 6,188,213 | B1 | 2/2001 | Buck | |
| 6,298,781 | B1 * | 10/2001 | Dufour | 101/483 |
| 6,302,392 | B1 | 10/2001 | Schaefer | |
| 6,712,749 | B1 * | 3/2004 | Michalik et al. | 493/424 |
| 6,899,026 | B2 * | 5/2005 | Weis | 101/225 |
| 7,637,211 | B2 * | 12/2009 | Berberich et al. | 101/485 |
| 2002/0043757 | A1 | 4/2002 | d'Agrella | |
| 2002/0065182 | A1 | 5/2002 | Jeschke | |
| 2009/0295058 | A1 * | 12/2009 | Schnell et al. | 270/41 |

FOREIGN PATENT DOCUMENTS

| | | |
|---|---|---|
| DE | 3626287 | 2/1988 |
| DE | 3942502 | 6/1990 |
| DE | 19509947 | 9/1996 |
| DE | 19525169 | 9/1996 |
| GB | 691 336 | 5/1953 |

* cited by examiner

*Primary Examiner* — Thanh K Truong
(74) *Attorney, Agent, or Firm* — Cohen Pontani Lieberman & Pavane LLP

(57) ABSTRACT

An apparatus for producing longitudinally folded products has a machine frame (17) which is arranged below a former arrangement which can be charged with web material. Transporting and processing units are arranged in tandem in the machine frame (17), and a superstructure wall (18) which carries web guiding members (19) associated with the former arrangement is mounted on the machine frame (17). At least one web ribbon (2*a*) is guided through the superstructure wall (18). The machine frame (17) has at least two modules (22, 23) arranged one above the other which are rotatable by 180° relative to one another and can be connected to one another. Each module (22, 23) has its own at least one drive motor, and every unit provided in the region of the dividing line (24) between modules (22, 23) which are rotatable relative to one another is constructed symmetrically with respect to a center working plane containing the axis of rotation.

23 Claims, 5 Drawing Sheets

APPARATUS FOR PRODUCING LONGITUDINALLY FOLDED PRODUCTS

BACKGROUND OF THE INVENTION

1. Field of the Invention

The invention is directed to an apparatus for producing longitudinally folded products having a machine frame which is arranged below a former arrangement. Transporting and processing units are arranged in tandem in the machine frame, and a superstructure wall which carries web guiding members associated with the former arrangement is mounted on the machine frame, at least one web ribbon being guided through the superstructure wall.

2. Description of the Related Art

In arrangements of the type mentioned above, the web guiding members must be easily accessible. Therefore, depending on the side at which the web material arrives, the superstructure wall carrying the web guiding members must be offset relative to one side or the other with respect to a center plane of the former arrangement. Formerly, in commonly used arrangements of this type the machine frame was constructed as a structural unit. Accordingly, the construction was stationary from the outset and could no longer be changed subsequently. Therefore, if the side from which the web material arrived were changed, this could not be accommodated in a simple manner. It was also not possible for the side toward which the generated product was delivered to be adapted to subsequent changing conditions. Accordingly, known arrangements of this type proved to be insufficiently flexible.

SUMMARY OF THE INVENTION

Therefore, it is an object of the present invention to improve an arrangement of the type mentioned above in a simple and economical manner in such a way that a high degree of flexibility and ability to adapt to individual situations is achieved.

According to the present invention, this object is met in that the machine frame has at least two modules arranged one above the other which are rotatable by 180° relative to one another and can be connected to one another, each module having its own at least one drive motor, and every unit provided in the region of the dividing line between modules which are rotatable relative to one another is constructed symmetrically with respect to a working plane containing the axis of rotation.

The disadvantages described above can be overcome by these steps in a simple and economical manner. The rotatability of the modules advantageously results in a high flexibility and ability to adapt to peripheral conditions which change subsequently. The symmetry which is provided, according to the present invention, in the region of the dividing line advantageously ensures that the conditions for connecting to the respective adjacent module are identical in all final positions of a module which are rotated relative to one another by 180° so that the rotation of a module can be carried out without any problems. This is additionally supported in an advantageous manner in that every module is self-sufficient with respect to its driving means.

In an advantageous manner, for example, two modules which are rotatable relative to one another by 180° can be provided, wherein the upper module contains draw-in and transporting devices for material webs exiting from the formers of the former arrangement, a cross cutting device for generating successive products, and a splitting device for dividing the product flow into two branch flows, and the lower module contains belt guides associated with the two branch flows and delivery fans which are arranged at the ends of the belt guides and which have an associated delivery belt and a braking unit which is preferably arranged in front. The rotatability of the upper module makes it possible to adapt the position of the superstructure wall received thereon to the feed direction of the web material regardless of the direction of the product delivery. The rotatability of the lower module advantageously makes it possible to adapt the delivery direction regardless of the actual position of the superstructure wall. Therefore, the proposed two modules afford a high degree of flexibility but are also constructed in a comparatively simple manner.

Advantageously at least the output of the splitting unit and the input of the belt guides associated with the branch flows are arranged in the area of the dividing line between the upper module and lower module so as to be symmetric to a vertical center plane containing the axis of rotation. This makes it possible to position the dividing line between the splitting unit and the input of the branch flows.

Another advantageous embodiment provides that each module contains a plurality of its own drive motors. In this way, not only the modules but also the individual units are autonomous with respect to driving means, which makes it possible to control speeds in an exact manner.

In a further advantageous development, all transporting and processing units have two tracks, the modules having side walls at a corresponding distance from one another. This further increases flexibility because one or two tracks can be operated regardless of the rotational position of the individual modules.

To further increase flexibility, the cross cutting device can have two cutting rollers which are associated with one another and which are mounted in rotatable eccentric bearings. This makes it possible to change the axial distance by rotating the eccentric bearings so that cutting rollers of different diameters can be used, which makes it possible to adapt the length of the folded products to be produced to individual cases.

According to another particularly preferred embodiment the splitting device has a stationary wedge which is constructed and arranged symmetrically with respect to the working plane and which engages between two guide plates which flank the wedge and which, together with the wedge, define a path fork which is symmetrical with respect to the working plane and opens downward. Two cam rollers which flank the guide plates and which are arranged symmetrically with respect to the working plane are associated with the guide plates, project through the respective adjacent guide plate in an alternating manner and, together with the other respective guide plate, form a feed for a belt guide associated with a branch flow. These steps advantageously result in a symmetrical construction of the splitting unit, and the cam rollers ensure a gentle handling of the passing products and a wear-free operation. Since there are no relative movements of the products with respect to the cam rollers, there is no risk of marks or smeared ink.

The cam rollers advantageously have along their length a plurality of cams which are arranged side by side at a distance from one another and the guide plates have a plurality of slots associated with the cams. This ensures a reliable, trouble-free operation regardless of the product width.

According to another advantageous embodiment the drive of the belt guides is derived from one of the existing motors and at least one belt roller of every belt guide is driven by means of an endless circulating member and is provided in the area of both ends with a driving element associated with the circulating member. Since drive elements which are symmetrical with respect to the center plane are provided at both ends of the driven belt rollers, each module can rotate easily.

BRIEF DESCRIPTION OF THE DRAWINGS

Further advantageous constructions and embodiments of the present invention are described in more detail in the following description with reference to the drawings in which.

DETAILED DESCRIPTION OF THE PRESENTLY PREFERRED EMBODIMENTS

Figure 1:
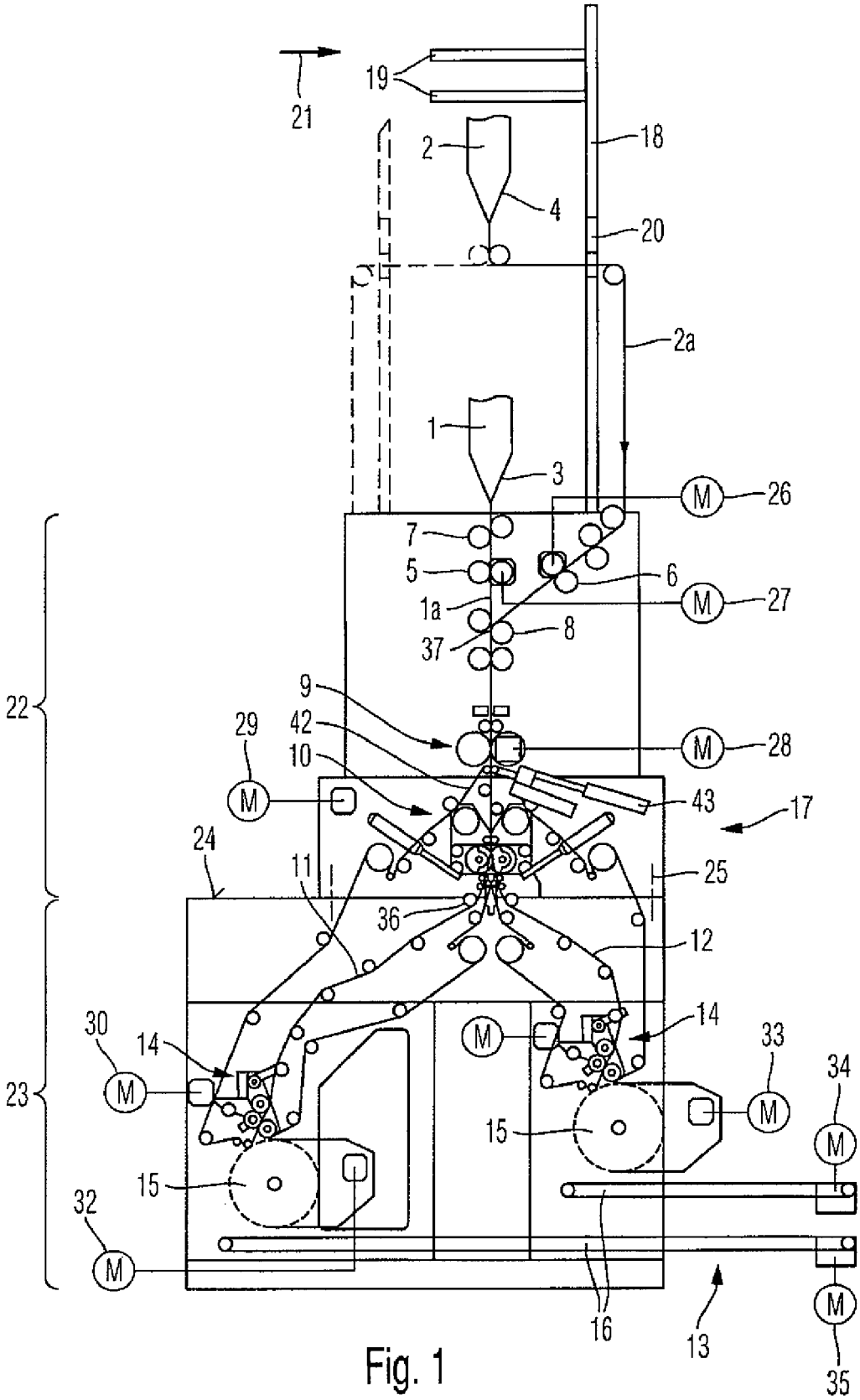
FIG. 1 is an overview of an apparatus according to the present invention.

The apparatus shown in FIG. 1 serves to process web material, preferably in the form of printed paper substrate webs, to form longitudinally folded products in sheet form such as newspapers, etc. The web material 1, 2 in the form of individual webs or in the form of web packages comprising a plurality of webs placed one on top of the other is fed to the formers 3, 4 of a former arrangement and provided with a longitudinal fold in this way. A draw-in device 5, 6 which pulls the associated web material 1 and 2, respectively, over the associated formers 3 and 4, respectively, is associated with each former 3, 4. The draw-in devices 5, 6 comprise two rollers which cooperate with one another. One of the rollers is driven, and guiding and deflecting rollers 7, 8 can be arranged in front of it and/or in back of it.

The longitudinally folded material, designated hereinafter as webs 1*a* and 2*a*, respectively, is subsequently divided into products in sheet form by a cross cutting device 9. The resulting product flow is subsequently divided into two branch flows by a splitting device 10 and transported to a product delivery 13 by two belt guides 11, 12 following the splitting device. A braking device 14 is associated with each belt guide 11, 12 in the end region of the latter followed by a delivery fan 15. Delivery belts 16 on which the products are delivered in the form of a layered flow are arranged below the delivery fans 15.

The above-mentioned units are arranged downstream of the draw-in devices 5, 6 in a machine frame 17 into which the webs 1*a*, 2*a* exiting from the formers 3, 4 run. The machine frame 17 has two side walls on which the above-mentioned devices are mounted. A superstructure wall 18 carrying the belt guiding members 19, such as the guide rods and/or turnover bars, etc, associated with the formers 3, 4 is mounted on the machine frame 17. These belt guiding members 19 are arranged in a cantilevering manner and are accordingly accessible from their end remote of the superstructure wall 18. The web 1*a* exiting from the lower former 3 runs downward without being deflected. The web 2*a* which exits from the upper former 4 and which is designated in practice as a balloon web is deflected to the side for passing around the lower former 1. For this purpose, the web 2*a* must be guided through the superstructure wall 18 which is provided with a through-window 20 for this purpose.

The superstructure wall 18 is arranged in such a way that the cantilevering guide members 19 are easily accessible from the side of the web feed indicated by arrow 21. The superstructure wall 18 is laterally offset relative to a center plane of the former arrangement. The direction of the web feed depends upon the arrangement of devices located upstream and can therefore change. When the web feed takes place from the side opposite to arrow 21, the superstructure wall 18 must be arranged on the other side of the former arrangement as is indicated by the dashed line in FIG. 1. Since the web 2*a* must be guided through the superstructure wall 18 and is first guided under the associated draw-in device 6 in the same plane as the web 1*a* exiting from the former 3, the web guide associated with this web 2*a* must also extend symmetrically with respect to the arrangement indicated by the solid line with respect to the plane defined by the common transporting plane of the webs which are guided in a coplanar manner. It may also be the case that the delivery belts 16 should deliver the products not to the right as in the embodiment example shown here but to the other, left-hand side.

In order to facilitate variations of the type mentioned above, the machine frame 17 is formed of a plurality of modules which are arranged one on top of the other and which are rotatable by 180° relative to one another and can be fastened to one another in the respective end positions. Two modules are sufficient in practice. Consequently, two modules, namely, an upper module 22 and a lower module 23, are provided in the present example. The upper module 22 contains the draw-in devices 5, 6 with associated guiding and deflecting rollers 7, 8, the cross cutting device 9 and the splitting device 10. The lower module 23 contains the belt guides 11, 12 following the splitting device 10, and the braking devices 14, delivery fans 15 and delivery belts 16 associated with these belt guides 11, 12. In the area of the dividing line 24 between the modules 22 and 23 which extends at right angles to the vertical axis of rotation, these modules 22 and 23 which are rotatable relative to one another have mutual contacting surfaces and fastening means 25, indicated by their center lines, for anchoring with respect to one another in any desired final rotational position when placed on top of one another. These fastening means 25 are arranged symmetrically with respect to a vertical working plane of an adjacent unit, which working plane contains the axis of rotation indicated as dotted line A in FIG. 1.

In order that the products can be guided past the dividing line 24 in the same manner in any rotational end position, the units provided in the area of the dividing line 24 are formed symmetrically with respect to their vertical working plane containing the axis of rotation A and consequently symmetrically with respect to their vertical center plane. The vertical working plane containing the axis of rotation A corresponds to a vertical center plane, i.e., the transporting plane of the products when passing through the dividing line 24. In the present embodiment example, this symmetry applies to the output of the splitting device 10 and the input of the belt guides 11, 12 adjoining the latter.

To facilitate the rotatability of the modules 22 and 23, every module is autonomous with respect to its driving means. For this purpose, every module has at least one drive motor dedicated to it. In the present example, a plurality of drive motors are advisably provided on every module. For example, each draw-in device 5, 6 has its own drive motor 26, 27. The cross cutting device 9 has its own drive motor 28 and the splitting device 10 has its own drive motor 29. Consequently, the upper module 22 contains four drive motors 26-29 which are independent from one another. The braking devices 14, delivery fans 15 and delivery belts 16 of the lower module are also assigned their own drive motors 30, 31 and 32, 33 and 34, 35, respectively. The lower module 22 accordingly contains six drive motors 30-35 which are independent from one another. The mutual independence of the drive motors 26-35 facilitates the control and implementation of leading or lagging, which has an advantageous effect on accuracy and gentle operation.

In the present example, the belt guides 11, 12 traverse the dividing line 24. Therefore, the belts of the belt guides 11, 12 must be removed before one of the modules 22, 23 is rotated. However, the inner belt pulleys 26 of the belt guides 11, 12 provided in the area of the dividing line 24 are arranged symmetrically with respect to the working plane mentioned above so that the belt configuration is the same before and after the rotation of the modules 22, 23.

After combining, the webs 1*a*, 2*a* exiting from the formers 3, 4 can be transported further so as to lie one on top of the other or side by side depending on the former arrangement. To keep every possibility open and to ensure high flexibility, all members and devices are formed in two tracks downstream of the combining point 37, i.e., in such a way that two webs can run side by side if required. The side walls of the frame of the modules 22, 23 are far enough apart to give the required working width. The devices according to FIGS. 2-8 are based on the two-track construction mentioned above.

Figure 2:
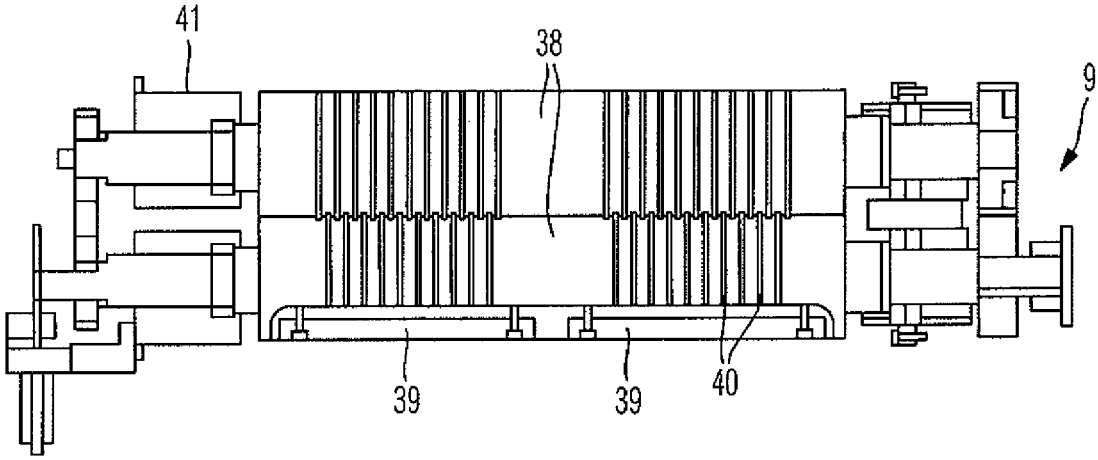
FIG. 2 is a view of the cross cutting device according to FIG. 1 in partial section.

The cutting device 9 shown in FIG. 2 comprises two parallel cutting cylinders which are adjusted toward one another along the circumference and which each have two adjacently arranged knives 39 each of which is associated with a track. In the region of their longitudinal portions respectively associated with a track, the cutting cylinders 38 are provided with circumferential grooves interrupted by the knives 39. Strips made of a compressible material, preferably Vulkollan, which project radially relative to the respective adjacent intermediate areas are pressed into the grooves and produce a minibeading of the continuous material. In this way, the start of the web which is produced again after every cut does not fan out even when the products comprise multiple layers.

The length of the products depends on the diameter of the cutting rollers 38. In case of a change in length, the cutting cylinders 38 must be exchanged. In order to facilitate this, the cutting cylinders 38 are mounted in lateral eccentric bearings 41. Therefore, the axial distance can be changed by rotating the eccentric bearings 41.

As can be seen from FIG. 1, the products produced by the action of the cross cutting device 9 run into a lead-in mouth of a belt guide portion 42 and are transferred from there to the splitting device 10. Backups can easily occur in the region of the above-mentioned lead-in mouth of the belt guide portion 42. In order to take countermeasures swiftly, one side of the belt guide portion 42 can be swiveled away from the opposite side. A swiveling cylinder 43 is provided for this purpose.

Figure 3:
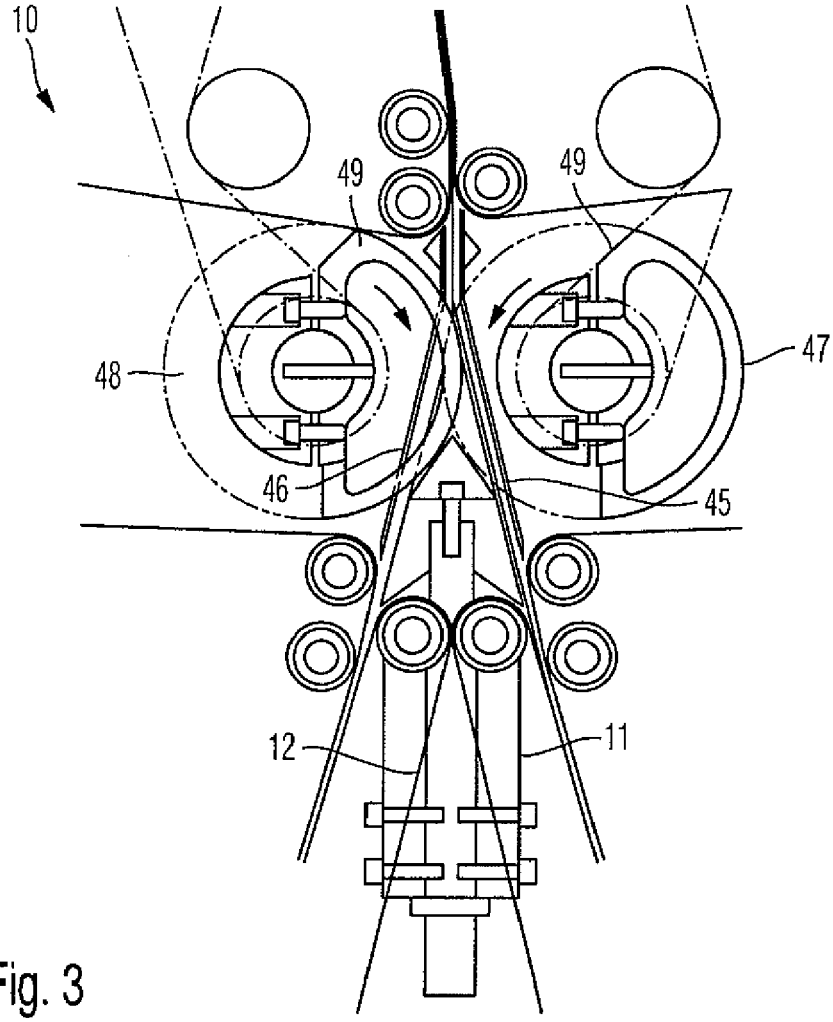
FIG. 3 is an enlarged view of the splitting device from FIG. 1.

As can be seen most clearly from FIG. 3, the splitting device 10 contains a stationary wedge 44 which is formed and arranged symmetrically with respect to its vertical working plane and which engages between two guide plates 45, 46 which flank it. Together with the wedge 44, these guide plates 45, 46 define a path fork which is symmetric to the above-mentioned working plane and opens downward. Two cam rollers 47, 48 which flank the guide plates 45, 46 and which are arranged symmetrically with respect to the above-mentioned working plane are associated with the guide plates 45, 46. The cam rollers 47, 48 are provided along their length with two sets of radially projecting cams 49 associated respectively with a track. The cams 49 of the cam rollers 47, 48 alternately project through the respective adjacent guide plate 45, 46 and, together with the other respective guide plate, form a feed for a belt guide 11, 12 associated with a branch flow.

Figure 4:
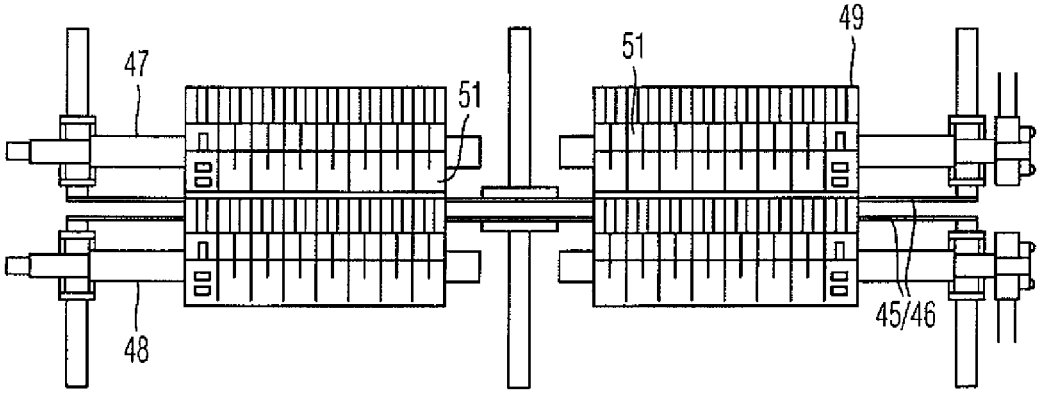
FIG. 4 is a top view of the cam rollers according to FIG. 3.
Figure 5:
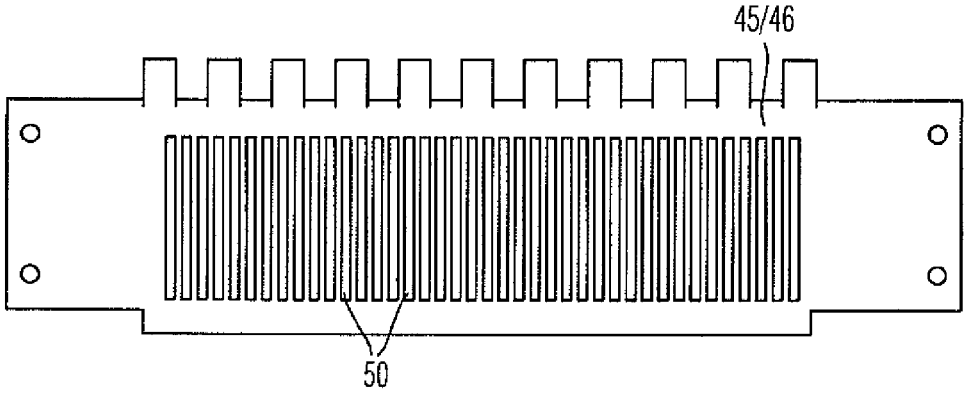
FIG. 5 is a top view of a guide plate from FIG. 2.

As can be seen most clearly from FIG. 4, the cam rollers 47, 48 are provided with many narrow, disk-shaped cams in two longitudinal areas associated with the above-mentioned tracks, narrow gaps being provided between these cams. As can be seen from FIG. 5, the guide plates 45, 46 are provided with narrow slots 50 which are associated with the narrow, disk-like cams 49 and in which the cams 49 can engage so as to mesh. In an advantageous manner, the wedge 44 is vertically adjustable. As can be seen from the movement arrows in FIG. 3, the cam rollers 47, 48 are driven in opposite directions and arranged in such a way that their cams 49 face in the same direction. This ensures that the cams 49 of the cam rollers 47, 48 alternately project through the slots 50 of the respective adjacent guide plate 45, 46.

As is shown in FIG. 4, the cam rollers 47, 48 have continuous shafts on which elements 51 are clamped, each of which contains a plurality of cams 49. These shafts are mounted in the area of their ends on the side walls of the associated module frame of the upper module 22. In the present example, this module 22 is provided with an intermediate wall on which the above-mentioned shafts can also be supported, which ensures a high stability and quiet running in spite of the large length and large imbalance caused by the elements 51.

Figure 6:
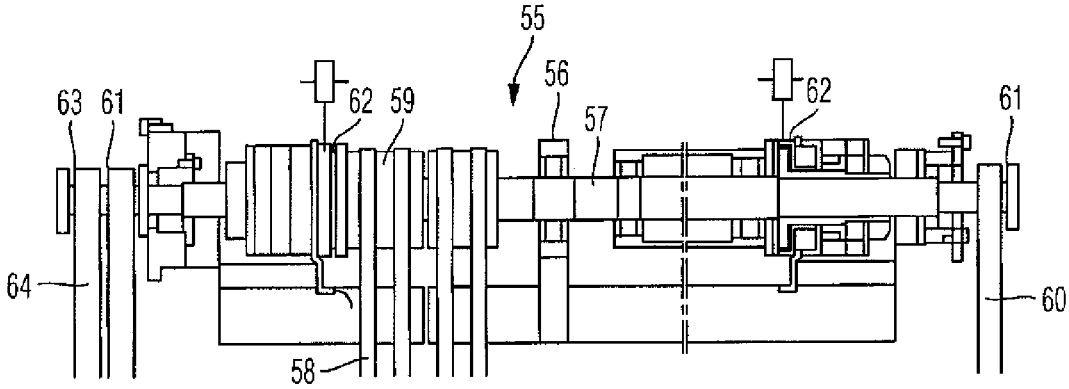
FIG. 6 is a view in partial section showing a belt roller of a belt guide, which belt roller is driven on two tracks.

FIG. 6 shows a driven belt roller 55 of the belt guides 11, 12. The belt roller 55 also has a shaft 57 which is continuous over the entire width, is mounted by its ends on the side walls I and II, and is supported in the middle on an intermediate wall 56. This shaft 57 is provided in the area of each track, i.e., in the area between the intermediate wall 56 and a respective side wall I or II, with belt pulleys associated with the belts 58 of the associated belt guide or, as in the example, with belt drums 59 around which a plurality of belts 58 are looped. The belt roller 55 is driven by a driving belt 60 which is driven derivatively by a drive motor of an adjacent processing unit, advisably by the drive motor 28 associated with the cross cutting device 9. With respect to the mutual rotatability of the two modules 22, 23, the shaft 57 is provided in the area of both ends with belt disks 61 which are arranged symmetrically with respect to the center plane, and a driving belt 60 leading to the cross cutting device 9 can be associated with these belt disks 60. Insofar as only one such driving belt is provided, this driving belt is placed on the belt disk 61 located on the correct side. The other remains empty.

In every case, the shaft 57 rotates over its entire length. However, the belts 58 assigned to the two tracks can be activated or deactivated per track. For this purpose, the associated belt pulleys or belt drums 59 are selectively coupled to the shaft 57 by means of a coupling 62. The drive can be transmitted to other driven belt rollers by the shaft 57 of the first belt roller 55, which shaft 57 has a drive-connection to the cross cutting device 9. For this purpose, a second belt disk 63, from which a driving belt 64 leads to a corresponding belt disk of another belt roller, is provided on one end of the shaft 57.

Figure 7:
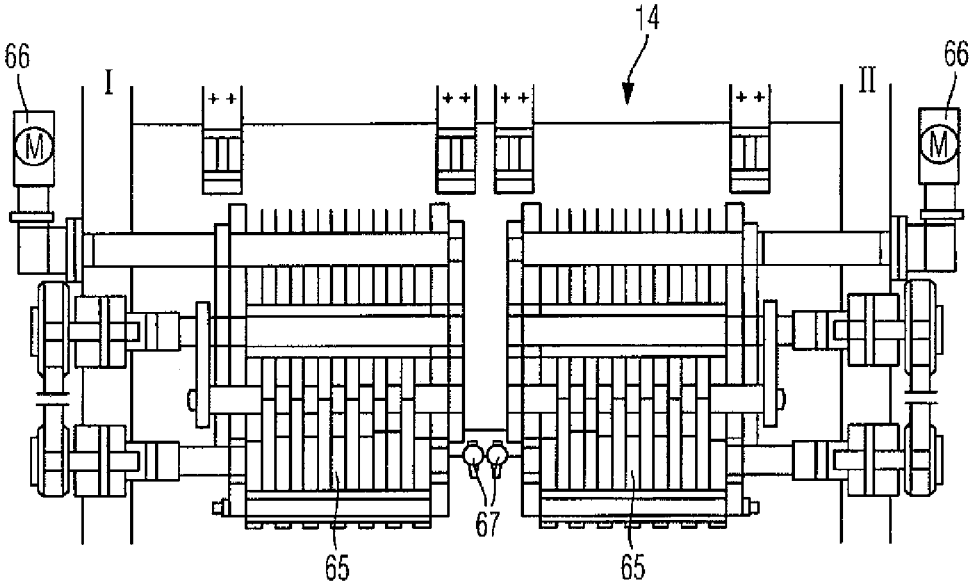
FIG. 7 is a top view in partial section showing a two-track braking device from FIG. 1.

As can be seen from FIG. 7, the braking devices 14 associated with the ends of the belt guides 11, 12 have two sets of braking cams 65 arranged side by side at a distance from one another along the width of the machine. These braking cam sets 65 can be adjusted independently from one another relative to an associated complementing member by means of an associated actuating motor 66. Sensors 67 which monitor the braking action can be associated with the actuating motors 66. In this way, the braking gap can be adjusted individually.

Figure 8:
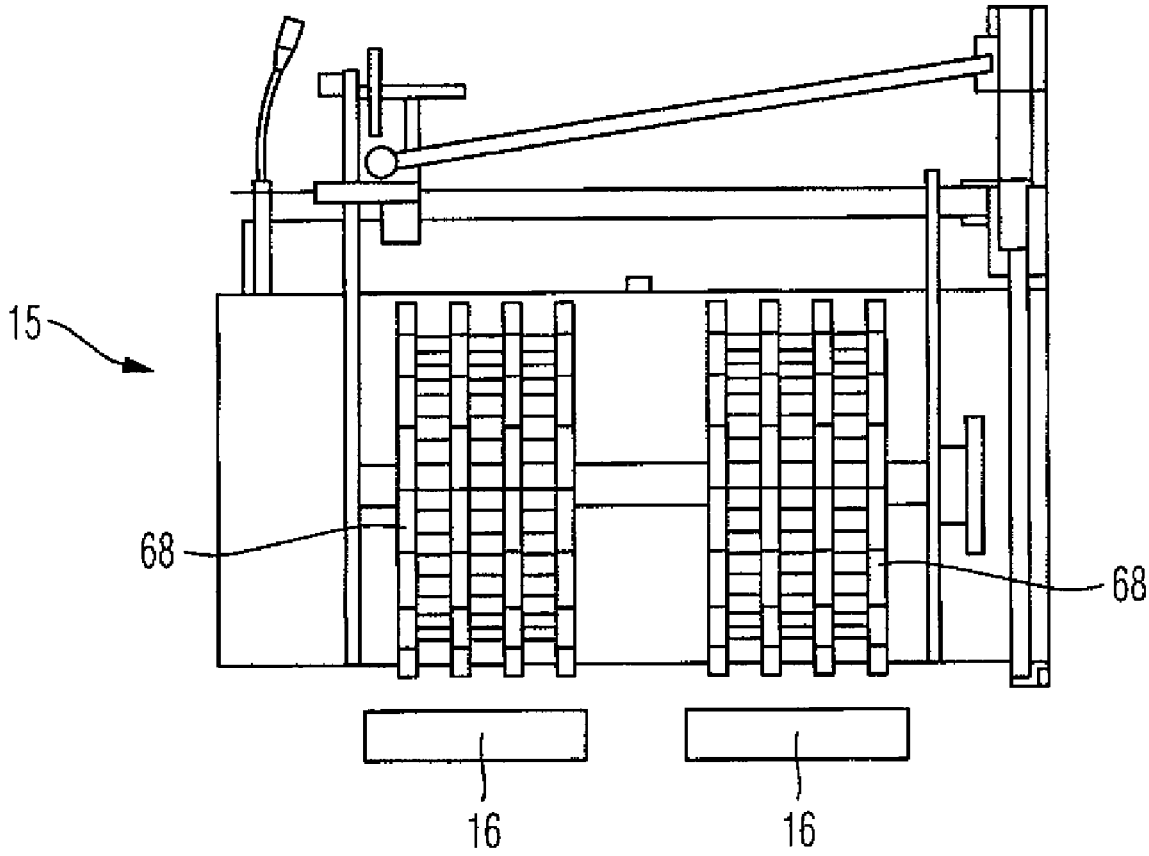
FIG. 8 is a top view showing a two-track delivery fan from FIG. 1.

As can be seen from FIG. 8, the delivery fans 15 provided above the delivery belts 16 contact blade sets 68 which are arranged side by side at a distance from one another along the width of the machine. Each set of blades 68 can have its own delivery belt 16. Every two delivery belts 16, only one of which is visible in FIG. 1, are arranged adjacent to one another as a result of the two-track design.

According to the example described above, the machine frame 17 contains only the upper module 22 and the lower module 23, that is, only two modules. However, it would also be possible to provide a plurality of modules. For this purpose, for example, the upper module 22 of the arrangement shown in FIG. 1 could be divided into a plurality of partial modules, for example, a first partial module containing the cross cutting device 9 and a second partial module containing the splitting device 10. The dividing line would then advisably lie directly below the cross cutting device 10.

The invention is not limited to the preferred embodiment example of the invention which is described in detail above. There are a number of possibilities available to the person skilled in the art to adapt the general idea to the specific conditions in individual cases.

The invention is not limited by the embodiments described above which are presented as examples only but can be modified in various ways within the scope of protection defined by the appended patent claims.

We claim:

1. An apparatus for producing longitudinally folded products; said apparatus comprising:

a former arrangement chargeable with a web material and a machine frame (17) arranged below said former arrangement;

transporting and processing units arranged in tandem in said machine frame;

a superstructure wall (18) mounted on said machine frame (17) for carrying web guiding members (19) associated with said former arrangement;

at least one web ribbon (2*a*) being guided through said superstructure wall (18);

said machine frame (17) comprising at least two modules (22, 23) arranged on opposite sides of a dividing line (24) one above the other and being rotatable by 180° around an axis of rotation relative to one another and connectable to one another;

each said module (22, 23) having its own at least one drive motor; and wherein every one of said units provided in the region of said dividing line (24) between said modules (22, 23) is constructed symmetrically with respect to a center working plane containing said axis of rotation.

2. The apparatus according to claim 1, wherein two modules (22, 23) which are rotatable relative to one another additionally comprising holding means (25) provided in the area of the dividing line (24), said holding means (25) being arranged symmetrically with respect to said center working plane containing said axis of rotation.

3. The apparatus according to claim 1, additionally comprising a former arrangement with two formers (3, 4) and an upper module (22), a lower module (23); and belt guides (11, 12), wherein said upper module (22) comprises draw-in and transporting devices (5, 6) for material webs (1*a*, 2*a*) exiting from said formers (3, 4), a cross cutting device (9) for generating successive products in form of a product flow; and a splitting device (10) for dividing said product flow into two branch flows; and said lower module (23) comprises belt guides (11, 12) associated with said two branch flows; delivery fans (15) arranged at the ends of said belt guides (11, 12); a delivery belt (16) associated with said delivery fans (15); and a braking unit (14) arranged in front of said delivery fans.

4. The apparatus according to claim 3, wherein said splitting device (10) has an output and said belt guides (11, 12) have an input associated with said branch flows; said inputs and outputs being arranged in the area of said dividing line (24) between said upper module (22) and lower module (23) so as to be symmetric with respect to said center working plane containing said axis of rotation.

5. The apparatus according to claim 3, wherein each of said modules (22, 23) comprises a plurality of drive motors.

6. The apparatus according to claim 5, wherein each of said draw-in and transporting devices (5, 6) of said cross cutting device (9), said splitting device (10) of said upper module (22), said delivery fans (15) and optionally said braking devices (14), of said lower module (23) comprises its own drive motor.

7. The apparatus according to claim 3, additionally comprising rotatable eccentric bearings and said cross cutting device (9) comprises two cutting rollers (38) which cooperate with one another and whose ends are mounted in said rotatable eccentric bearings (41).

8. The apparatus according to claim 7, wherein said cross cutting device (9) comprises cutting rollers (38), said cutting rollers (38) including knives (39) which are adjustable in a radial direction; and circumferential strips (40) of elastic material interrupted by said knives.

9. The apparatus according to claim 3, additionally comprising a cutting gap associated with said cross cutting device (9); and a belt guide (42) including a lead-in gap leading to said splitting device (9); said lead-in gap being disposed downstream of said cutting gap; said apparatus additionally comprising an actuating device (43) for laterally opening said lead-in gap.

10. The apparatus according to claim 3, additionally comprising two guide plates (45, 46); and wherein said splitting device (10) comprises a stationary wedge (44) constructed and arranged symmetrically with respect to said center working plane and which engages between said two guide plates (45, 46) said guide plate (45) flanking said wedge (44) and together with said wedge (44), define a path fork; said apparatus further comprising two cam rollers (47, 48) which flank the guide plates (45, 46) and which are arranged symmetrically with respect to said center working plane; said cam rollers projecting through a respective one of said adjacent guide plates (45, 46) in an alternating manner and, together with said other respective guide plate (45, 46), forming a feed for said belt guide (11, 12) associated with said branch flow.

11. The apparatus according to claim 10, wherein the cam rollers (47, 48) have along their length a plurality of cams (49) which are arranged side by side at a distance from one another; and said guide plates (45, 46) have a plurality of slots (50) associated with said cams (49).

12. The apparatus according to claim 10, wherein said wedge (44) is vertically adjustable.

13. The apparatus according to claim 10, wherein said cam rollers (47, 48) are driven in opposite directions and are arranged in such a way that the cams (49) of said two cam rollers (47, 48) face in the same direction.

14. The apparatus according to claim 10, said shafts comprising cam rollers (47, 48) having continuous shafts, said shafts comprising cam carriers (51) and a plurality of cams (49) clamped to said cam carriers (51).

15. The apparatus according to claim 3, wherein each said delivery fan (15) has blade sets (68) which are arranged side by side at a distance from one another over the width of the apparatus (2); each set of blades (68) having its own delivery belt (16).

16. The apparatus according to claim 1, wherein all said transporting and processing units are constructed so as to have two tracks; and said modules (22, 23) further comprising side walls at a distance from one another.

17. The apparatus according to claim 1, additionally comprising belt drives (11, 12) and at least one of said transporting and processing units is driven by a dedicated motor; and wherein said belt guides (11, 12) are driven by said motor of one of said transporting and processing unit.

18. The apparatus according to claim 17, wherein said unit is a cross cutting device (9) and said belt guides (11, 12) are driven by said motor of said cross cutting device (9).

19. The apparatus according to claim 17, additionally comprising belt rollers having opposite ends and belt guides (11, 12); and an endless circulating member (60); and wherein at least one of said belt rollers (55) of each belt guide (11, 12) is driven by said endless circulating member (60) and is provided in the area of both of said ends with a driving element (61) associated with said circulating member (60).

20. The apparatus according to claim 17, wherein each of said belt drives (11, 12) includes a driven belt roller (55); each said belt roller (55) having a shaft (57) which is continuous over the width of the apparatus for carrying driving elements (61), said shaft further comprising two sets of deflecting members (59) arranged on said shaft (57) and a coupling (62) for selectively coupling said deflecting members (59) to said shaft (57).

21. The apparatus according to claim 1, additionally comprising actuating motors (66) and a braking device (14); each braking device (14) having sets of braking cams (65) arranged side by side at a distance from one another over the width of the apparatus (2), and wherein each set of breaking cams is assigned its own actuating motor (66).

22. The apparatus according to claim 21, additionally comprising a sensor (67) and wherein said actuating motor (66) can be controlled by means of said sensor (67).

23. The apparatus according to claim 1, additionally comprising a cross-cutting device (9) and wherein at least one of said modules is divided into a plurality of two partial modules which are rotatable by 180° relative to one another; and wherein said dividing line preferably runs directly below said cross cutting device (9).

* * * * *